US006460904B1

(12) United States Patent
Stapf

(10) Patent No.: US 6,460,904 B1
(45) Date of Patent: Oct. 8, 2002

(54) INNER ACTUATION FOR AUTOMOBILES DOOR LOCKS

(75) Inventor: Uwe Stapf, Röttingen (DE)

(73) Assignee: ITW-ATECO GmbH, Rottingen (DE)

( * ) Notice: Subject to any disclaimer, the term of this patent is extended or adjusted under 35 U.S.C. 154(b) by 0 days.

(21) Appl. No.: 09/510,297

(22) Filed: Feb. 22, 2000

(30) Foreign Application Priority Data

Feb. 23, 1999 (DE) ..... 199 07 683

(51) Int. Cl.[7] ..... E05B 3/00

(52) U.S. Cl. ..... 292/336.3; 292/DIG. 8; 292/DIG. 22; 292/DIG. 31

(58) Field of Search ..... 292/336.3, 347, 292/348, DIG. 8, DIG. 22, DIG. 31; 16/354, 412, 438

(56) References Cited

U.S. PATENT DOCUMENTS 4,838,590 A * 6/1989 Isomura ..... 292/336.3
5,669,642 A * 9/1997 Kang ..... 292/336.3
5,743,575 A * 4/1998 McFarland ..... 292/336.3
6,095,573 A * 8/2000 Rozema ..... 292/51
6,182,483 B1 * 2/2001 von Kathen et al. .. 292/336.3 X
6,241,294 B1 * 6/2001 Young et al. ..... 292/336.3
6,264,257 B1 * 7/2001 Meinke ..... 292/336.3

* cited by examiner

*Primary Examiner*—Anthony Knight
*Assistant Examiner*—Ruth C. Rodriguez
(74) *Attorney, Agent, or Firm*—Lowe Hauptman Gilman & Berner, LLP

(57) ABSTRACT

Inner door lock actuator for automobiles comprises a lever-like handle which is pivotally supported in a housing about an approximately vertical shaft. The housing is attached to the door. A linkage or an actuation cord connects the handle to the door lock. A spring is arranged on the shaft for biasing the handle toward a non-actuated position. A portion of the handle is provided with a gear segment. A rotary damper is located in the housing and has a rotor shaft, a pinion being attached to the rotor shaft and meshing with the gear segment.

20 Claims, 1 Drawing Sheet

INNER ACTUATION FOR AUTOMOBILES DOOR LOCKS

TECHNICAL FIELD

The invention relates to an inner actuator automobile door locks which includes a damping mechanism.

BACKGROUND ART

Inner actuators for door locks comprise at least one lever-like handle which is pivoted into the inner space of the automobile by the driver or travelling person in order to open the door. The lever-like handle is pivoted about an approximately vertical shaft. The lever-like handle is biased by a spring which after the actuation sets the handle back to its initial or idle position. The actuation of the lever-like handle activates movements of a rod or tension cable in order to release the lock.

The biasing spring is to be dimensioned adequately strong so as to effectively return the lever-like handle after actuation. If the handle however after actuation is allowed to rapidly restore its original position it returns with a relatively unpleasant noise.

SUMMARY OF THE INVENTION

It is therefore an object of the invention to provide an inner door lock actuator for automobiles in which return of he actuator after actuation is effected without noise.

The above and other objects of the invention is/are achieved by a lever-like handle provided with a gear segment, and a rotary damping mechanism provided with a pinion engageable with the gear segment. In this manner, the movement of the door inner handle caused by a biasing spring is dampened when the handle is released. When the handle is actuated against a braking force of the spring, the rotary damper is likewise actuated. It may therefore be advantageous to equip the rotary damper with a so-called free-run so that actuation of the handle does not need to be effected against the braking force of the rotary damper.

Alternatively, a rotor shaft of the rotary damping mechanism may be coupled rotationally rigidly to a shaft which in turn is rotationally rigidly connected to the handle. In this arrangement, the connection between the rotary damping mechanism and the handle may be achieved without using a pinion and a gear segment.

The rotary damper may also be integrated into the shaft which is particularly space-saving.

The rotary damping mechanism may be arranged on the rotational shaft of the handle or eccentrically therewith. A gear segment is preferably attached or formed on a shorter leg portion of the approximately hook-shaped handle, wherein both leg portions of the handle are mounted in parallel and spaced from each other on the shaft. A restoring spring is preferably arranged between the leg portions.

The housing of the rotary damper is to be mounted in an opening of the actuator housing, and specifically in a rotationally rigid manner. This may be effected in a known manner. Alternatively, the housing of the rotary damper may comprise a radial flange and be inserted into a fittingly formed insertion recess of the actuator housing.

The return of the handle may be effected by a spring on the shaft or in the lock of the door.

BRIEF DESCRIPTION OF THE DRAWINGS

Exemplary embodiments of the invention will be hereinafter described in more detail by way of reference to the drawings.

DETAILED DESCRIPTION OF THE INVENTION

Figure 1:
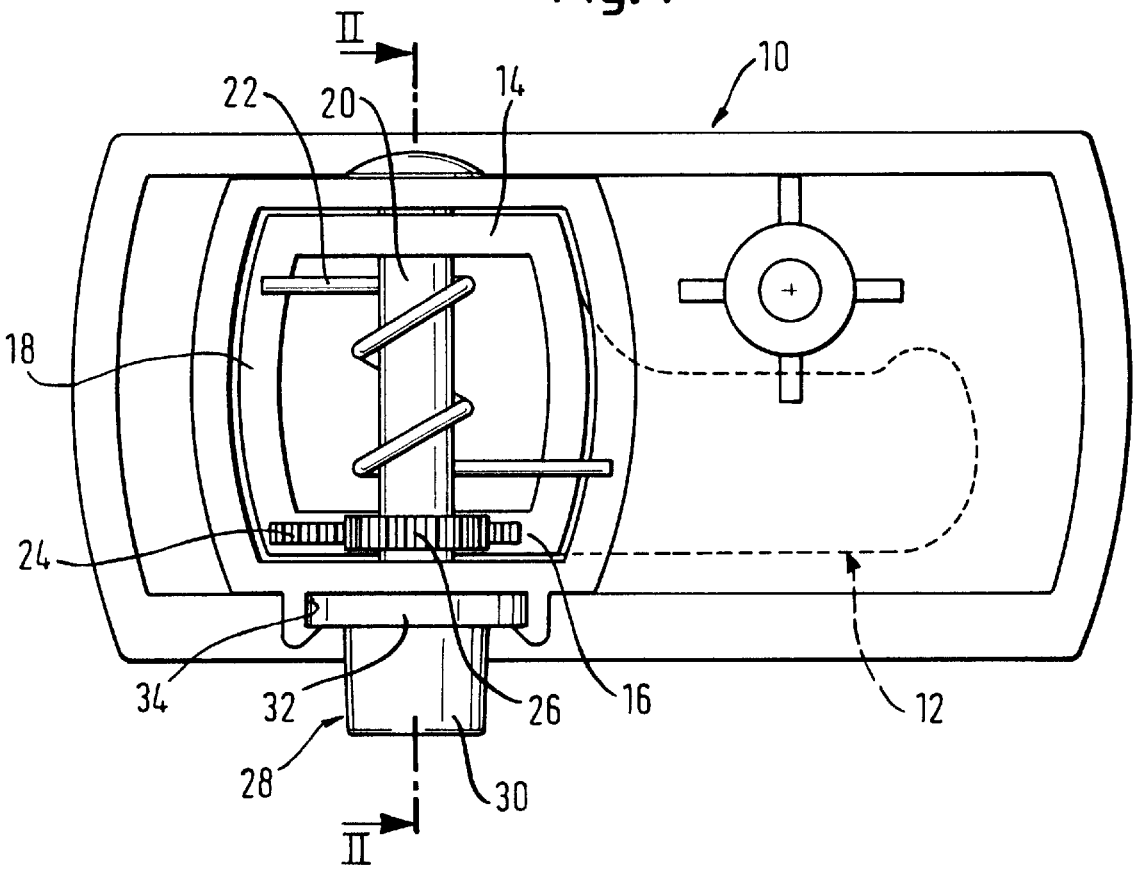
FIG. 1 shows a schematic rear view of an inner door lock actuator according to a first embodiment of the invention.

The inner door lock actuator depicted in FIG. 1 has a housing 10 which is formed box-like and is mounted inside an automobile door (not shown). A lever-like handle 12 which is formed hook-shaped, as best seen in Fig, 2, and has legs 14, 16 connected to one another via a bent portion 18, is pivotally mounted on a shaft 20 rigidly connected to the housing 10. The shaft 20 extends approximately vertically. Between the leg portions 14, 16, a spring 22 is arranged on the shaft 20. One end of the spring 22 bears against the portion 18 of the handle 12 whilst the other end is connected to the housing 10, 14. By way of this, the handle 12 is biased toward an idle position.

Figure 2:
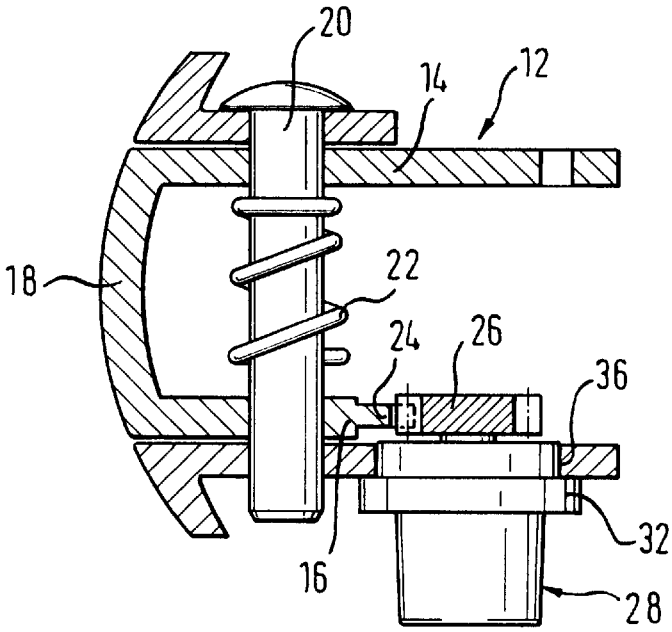
FIG. 2 shows a cross-sectional view of an inner door lock actuator according to a second embodiment of the invention of the invention, which is identical to the first embodiment except rotary damper 28 being formed eccentrically with respect to rotational axis 20, the cross-sectional view being taken along line II—II shown in FIG. 1.

As best seen in FIG. 2 one may recognize that the shorter leg portion 16 is provided with a gear segment 24 which meshes with a pinion 26. The pinion 26 in FIG. 1 is arranged coaxially with the shaft 20 and is rotatably on the shaft. The pinion 26 is seated on a rotor shaft (not shown) of a rotary damper 28, whose housing 30 is provided with an annular flange 32 which is fit to a recess 34 of the housing 10. The rotary damper 28 is thus fixed in its position to the housing 10. Actuation of the actuator handle 12 also actuates the rotary damper 30 like when the handle is released and the spring 22 pivots the handle back to the initial position.

In the embodiment according to FIG. 2, the rotary damper 28 is seated in a front portion in an opening 36 of the housing 10, 14, wherein the annular flange 32 bears, from the outside, against the housing wall. One will recognize that the shorter leg portion 16 of the handle 12 comprises a gear segment 24 which meshes with the pinion 26 of the rotary damper 28. The rotary damper 28 is, however, arranged eccentrically with respect to the shaft 20.

What is claimed is:

1. An inner door lock actuator, comprising:

a housing;

a rotational shaft fixed to the housing;

a handle formed as a lever pivotably mounted on the rotational shaft and having a gear segment;

a spring element attached to the housing and the handle for biasing the handle toward a non-actuated position; and a rotary damper having a pinion meshing with the gear segment, whereby after the handle has been actuated, by an actuation movement against a biasing force of the spring element, to move from the non-actuated position, a return movement of the handle to the non-actuated position is damped by the rotary damper;

wherein the rotary damper is arranged on the rotational shaft.

2. An inner actuator for unlatching a lock of an automobile door, said actuator comprising:

a housing attached to the automobile door;

a rotational shaft fixed to the housing;

a handle formed as a lever pivotably mounted on the rotational shaft and having a gear segment;

a spring element arranged on the rotational shaft for biasing the handle toward a non-actuated position; and a rotary damper having a pinion meshing with the gear segment;

wherein a wall of the housing has an opening, and a damper housing of the rotary damper is placed in the opening.

3. An inner actuator for unlatching a lock of an automobile door, said actuator comprising:

a housing attached to the automobile door;

a rotational shaft fixed to the housing;

a handle formed as a lever pivotably mounted on the rotational shaft and having a gear segment;

a spring element arranged on the rotational shaft for biasing the handle toward a non-actuated position; and a rotary damper having a damper housing and a pinion meshing with the gear segment;

wherein the damper housing has a radial flange, and the housing at an outer side thereof has a recess, the radial flange of the damper housing is slidably fit into the recess.

4. An inner door lock actuator, comprising:

a housing;

a rotational shaft fixed to the housing;

a handle formed as a lever pivotably mounted on the rotational shaft and having a gear segment;

a spring element attached to the housing and the handle for biasing the handle toward a non-actuated position; and a rotary damper having a pinion meshing with the gear segment, whereby after the handle has been actuated, by an actuation movement against a biasing force of the spring element, to move from the non-actuated position, a return movement of the handle to the non-actuated position is damped by the rotary damper;

wherein the rotary damper further includes a rotor shaft on which the pinion is rotatably seated; and wherein the rotor shaft and the rotational shaft are coaxial.

5. The actuator of claim 4, wherein the rotary damper further comprises a damper housing for accommodating at least partially the rotor shaft, the damper housing having a radial flange and fittingly received in an opening formed on a wall of the housing with the radial flange resting on an inner surface of the wall.

6. The actuator of claim 5, wherein the pinion is arranged without the damper housing and within the housing.

7. An inner door lock actuator, comprising:

a housing;

a rotational shaft fixed to the housing;

a handle formed as a lever pivotably mounted on the rotational shaft and having a gear segment;

a spring element attached to the housing and the handle for biasing the handle toward a non-actuated position; and a rotary damper having a pinion meshing with the gear segment, whereby after the handle has been actuated, by an actuation movement against a biasing force of the spring element, to move from the non-actuated position, a return movement of the handle to the non-actuated position is damped by the rotary damper; wherein the rotary damper further includes a rotor shaft on which the pinion is rotatably seated;

the rotor shaft is arranged eccentrically with respect to the rotational shaft; and the rotary damper further comprises a damper housing for accommodating at least partially the rotor shaft, the damper housing having a radial flange and fittingly received in an opening formed on a wall of the housing with the radial flange resting on an outer surface of the wall.

8. The actuator of claim 7, wherein the pinion is arranged without the damper housing and within the housing.

9. An inner door lock actuator, comprising:

a housing;

a rotational shaft fixed to the housing;

a handle formed as a lever pivotably mounted on the rotational shaft and having a gear segment;

a spring element attached to the housing and the handle for biasing the handle toward a non-actuated position; and a rotary damper having a pinion meshing with the gear segment, whereby after the handle has been actuated, by an actuation movement against a biasing force of the spring element, to move from the non-actuated position, a return movement of the handle to the non-actuated position is damped by the rotary damper.

10. The actuator of claim 9, wherein the rotational shaft is oriented substantially vertically.

11. The actuator of claim 9, wherein the spring element is arranged on the rotational shaft.

12. The actuator of claim 9, wherein the rotary damper further includes a rotor shaft on which the pinion is rotatably seated.

13. The actuator of claim 12, wherein the rotor shaft is arranged eccentrically with respect to the rotational shaft.

14. An inner actuator for unlatching a lock of an automobile door, said actuator comprising:

a housing attached to the automobile door;

a rotational shaft fixed to the housing;

a handle formed as a lever pivotably mounted on the rotational shaft and having a gear segment;

a spring element arranged on the rotational shaft for biasing the handle toward a non-actuated position; and a rotary damper having a pinion meshing with the gear segment;

wherein the handle has a hook-shaped cross-section including a long leg portion and a short leg portion connected with each other via a connecting portion, the leg portions being pivotably supported on the rotational shaft, and the gear segment is formed on the short leg portion of the handle.

15. The actuator of claim 14, wherein the spring element is located between the leg portions.

16. The actuator of claim 14, further comprising a link connecting the handle to the lock of the automobile door.

17. The actuator of claim 14, wherein the leg portions are substantially parallel and are mounted on the rotational shaft at axially spaced locations.

18. The actuator of claim 14, wherein the gear segment is formed at a distal end of the short leg portion with respect to the connecting portion.

19. The actuator of claim 14, wherein the connecting portion is a bent portion.

20. The actuator of claim 14, wherein the spring element is a coil spring having one end attached to the housing and the other end attached to the connecting portion of the handle.

* * * * *